United States Patent [19]

Freeman et al.

[11] Patent Number: 5,063,790

[45] Date of Patent: Nov. 12, 1991

[54] PIPETTE TIP PICKUP APPARATUS

[75] Inventors: Richard H. M. Freeman, Scotland, Great Britain; Abram D. Yeudall, Troon, Scotland

[73] Assignee: Flow Laboratories Limited, Irvine, Scotland

[21] Appl. No.: 336,036

[22] Filed: Apr. 11, 1989

[30] Foreign Application Priority Data

Apr. 12, 1988 [ES] Spain ..... 880583

[51] Int. Cl.[5] ..... B01L 3/02

[52] U.S. Cl. ..... 73/864.14; 422/99; 422/100; 141/346; 222/566; 222/567

[58] Field of Search ..... 422/99, 100; 436/54, 436/63; 73/864.11-864.25; 222/566, 567; 141/346, 353, 354, 383, 384, 385, 386

[56] References Cited

U.S. PATENT DOCUMENTS

| | | | |
|---|---|---|---|
| 4,187,724 | 2/1980 | Citrin | 73/864.14 |
| 4,824,641 | 4/1989 | Williams | 73/864.12 |
| 4,863,695 | 12/1989 | Fullemann | 73/864.14 |
| 4,965,050 | 10/1990 | Jessop | 73/864.14 |

*Primary Examiner*—Robert J. Warden
*Assistant Examiner*—Laura E. Collins
*Attorney, Agent, or Firm*—Ratner & Prestia

[57] ABSTRACT

In a liquid handling station taking up and dispensing liquid through one or a plurality of pipettes each having a syringe and a respective nozzle, it is customary to fit the nozzle(s) with a disposable pippette tip(s) which is replaced between samples to avoid cross-contamination. There are difficulties in reliably fitting and sealing these pipette tips onto the nozzles. The present invention simplifies the fitting and sealing of pipette tips onto nozzles by forming each nozzle with an annular groove having a controllably variable axial width. An elastomeric O-ring seal is fitted in each annular groove. The nozzle and its fitted O-ring seal is inserted into a pipette tip, and then the axial width of the annular groove is controllably reduced to cause a circumferential expansion of the O-ring seal. The nozzle and the pipette tip become mechanically and sealingly attached without the pipette tip having to be force-fitted onto the nozzle as was previously necessary. The pipette tip is subsequently detached by controllably increasing the axial width of the annular groove to allow a circumferential contraction of the O-ring seal. Manufacturing tolerances in the pipette tips do not have an adverse effect on the resultant nozzle/tip seal.

14 Claims, 3 Drawing Sheets

PIPETTE TIP PICKUP APPARATUS

This invention relates to pipette tip pickup apparatus for use with liquid handling stations which carry out test and analysis procedures on liquid samples and sample solutions.

BACKGROUND OF THE INVENTION

A known type of liquid handling station has a series of syringe nozzles to which pipette tips are attached for handling liquids.

A difficulty with said apparatus is that any change of liquid being handled by the apparatus necessitates a change of pipette tips. At the same time it is important that a good seal is obtained between each syringe nozzle and its respective tip as any leakage can lead to a lack of accuracy in the amount of liquid handled by the tip. Previously the tips have been forced either manually or mechanically onto the nozzles to obtain an interference fit. Such a process is not consistently successful and is affected by tolerances of the tip.

OBJECT OF THE INVENTION

It is therefore an object of the invention to provide an improved pipette tip pickup apparatus in which the foregoing disadvantages are obviated or mitigated.

SUMMARY OF THE INVENTION

According to the present invention there is provided pipette tip pickup apparatus, said apparatus comprising a syringe barrel having a nozzle to which a pipette tip may be attached or from which the pipette tip may be detached, the nozzle having an external annular groove, means to controllably vary the axial width of said annular groove, and an elastomeric O-ring seal disposed in said annular groove, the apparatus being such that upon insertion of the nozzle into a pipette tip, the axial width of the annular groove may be controllably decreased to cause a circumferential expansion of the O-ring seal whereby the nozzle becomes mechanically and sealingly attached to the pipette tip.

A controlled increase in the axial width of the annular groove will allow a circumferential contraction of the O-ring seal whereby the pipette tip becomes unsealed and detached from the nozzle.

The annular groove may be externally formed on the nozzle between a shoulder on the nozzle tip and the adjacent end of a sleeve axially movable on the exterior of the nozzle. The sleeve is preferably screw-threaded on the nozzle whereby rotation of the sleeve on the nozzle causes axial displacement of the sleeve relative to the shoulder on the nozzle tip with consequent variation of the axial width of the annular groove formed therebetween. The sleeve may be rotatable on the nozzle by being gearingly coupled to a gear mechanism comprised in said means to controllably vary the axial width of the annular groove. The gear mechanism may comprise a toothed rack slidable tangentially relative to the nozzle and engaging a toothed pinion formed on or secured to the sleeve. The rack may be mechanically linked to a manually rotatable operating handle, rotation of the operating handle linking through the gear mechanism to rotate the sleeve and hence control variation of the axial width of the annular groove.

Alternatively, the sleeve may be rotatable on the nozzle by means of an electric motor, which may be gear-coupled to the sleeve.

The pipette tip pickup apparatus may alternatively comprise a plurality of syringe barrels arranged in a substantially straight row with substantially parallel axes, each syringe barrel having a respective nozzle to which a respective pipette tip may be attached or from which the pipette tips may be detached, each said nozzle having a respective external annular groove, means to controllably and conjointly vary the axial width of each said annular groove, and a respective elastomeric O-ring seal disposed in each said annular groove, the apparatus being such that upon insertion of each nozzle into a respective pipette tip, the axial width of each annular groove may be controllably and conjointly decreased to cause circumferential expansion of each O-ring seal whereby each nozzle becomes mechanically and sealingly attached to the respective pipette tip.

The form of the apparatus with the plurality of syringe barrels may have the components associated with individual ones of the nozzles substantially the same as the equivalent components in the form of the apparatus with a single syringe barrel, but multiplied as requisite by the number of syringe barrels save for components that are common to all nozzles, as, for example, a single rack which may gearingly link with each sleeve whereby movement of the single rack causes conjoint movement of each sleeve. Where the sleeves are individually driven by a respective electric motor, the motors are preferably controlled for conjoint operation by being controllably connected to a common electric power supply.

The pipette tip pickup apparatus (whether with a single syringe barrel or with a plurality of syringe barrels) preferably forms part of a liquid handling station, which in turn preferably forms part of analytical apparatus for carrying out test and analysis procedures on liquid samples and sample solutions (such solutions possibly being formed by liquid samples that have been subjected to predetermined dilution in a solvent).

BRIEF DESCRIPTION OF THE DRAWINGS

Embodiments of the present invention will now be described, by way of example, with reference to the accompanying drawings, in which.

DESCRIPTION OF PREFERRED EMBODIMENTS

Figure 1:
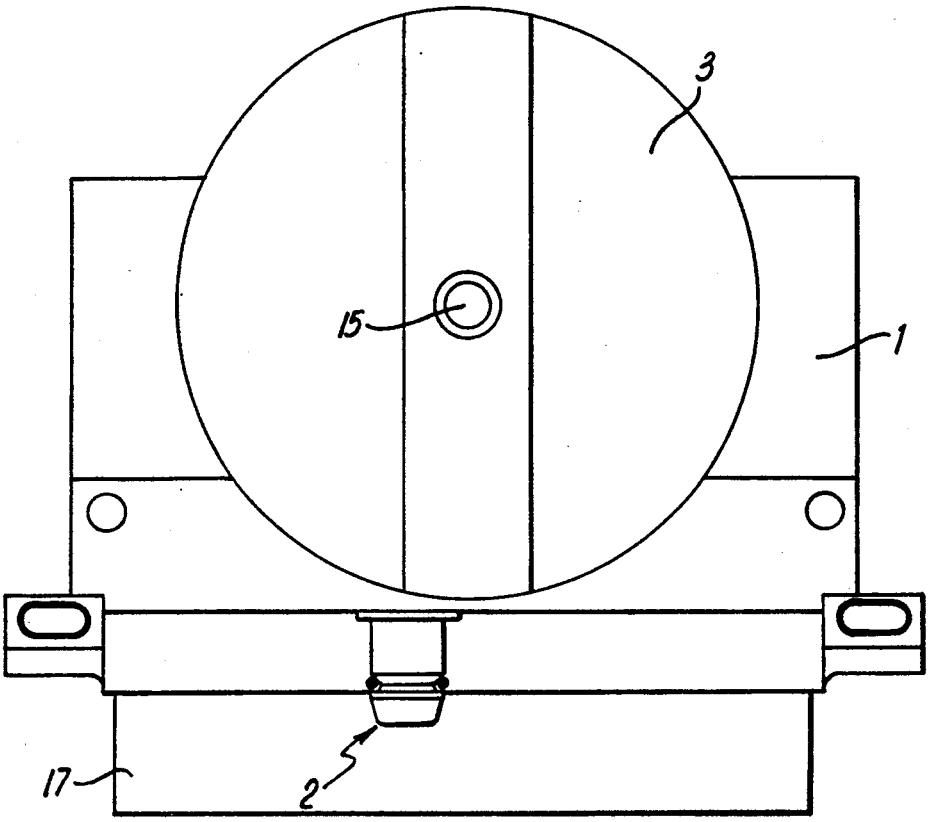
FIG. 1 is a front view of a first embodiment of pipette tip pickup apparatus in accordance with the present invention.

Referring to FIGS. 1 to 4 of the drawings, a first embodiment of pipette tip pickup apparatus comprises a support body 1, a nozzle assembly 2 and a rotatable operating handle 3.

The nozzle assembly 2 comprises a threaded upper end portion 6, a main body portion 7 having an externally screw-threaded portion 8 and a lower end tip 10. A sleeve 9 fits over the main body portion and is internally screw-threaded to engage the externally screw-threaded portion 8 of the nozzle assembly 2 so that on rotation the sleeve 9 moves axially along the body portion 7 (either towards or away from the nozzle tip 10 according to the direction of rotation of the sleeve 9 relative to the body portion 7). An elastomeric O-ring seal 11 is disposed between the sleeve 9 and the nozzle tip 10. The sleeve 9 has a gear 12 formed on or secured to its upper end.

The support body 1 is formed with a cylindrical syringe barrel 4 in which a liquid control piston, not illustrated, is loated and axially movable. At the base of the syring barrel 4 a threaded bore 5 receives the threaded end portion 6 of the nozzle assembly 2 to complete a sealed pneumatic/hydraulic fluid connection between the syringe barrel 4 and the nozzle tip 10. Upward movement of the liquid control piston in the syringe barrel 4 draws in a column of air so that liquid is drawn into a pipette tip located on the nozzle assembly 2. It is thus important that the pipette tip achieves an air-tight seal with the nozzle 3. The gear 12 on the sleeve 9 is engaged by a rack 13 slidable in the body 1. A projection on the top rack 13 is engaged by a pin 14 which extends from the body 1 into a slot 19 in the rotatable operating handle 3 which pivots on the body 1 by means of a pivot bolt 15.

Figure 4:
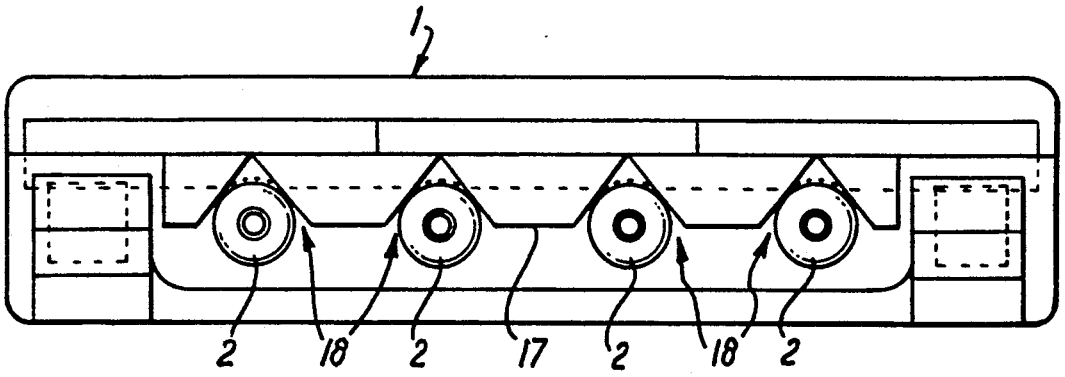
FIG. 4 is a bottom plan view of the apparatus of FIG. 1.

In FIG. 1 only a single nozzle assembly 2 is illustrated for clarity but as can be seen in FIG. 4 the embodiment illustrated can have four such nozzle assemblies, one for each of four syringe barrels (not shown in FIG. 4).

In use the pipette tip pickup apparatus of FIGS. 1 to 4 is included as part of a liquid handling station and is mounted so as to be movable thereon. (The liquid handling station may form part of analytical apparatus for carrying out test and analysis procedures on liquid samples and sample solutions). The pipette tip pickup apparatus is first moved to a position above an array of pipette tips which are supported in a support plate. A guide plate 17 extends below the body 1 and has a series of notches 18 which on lowering the pickup apparatus engage pipette tips 16 to position them so that each nozzle assembly 2 enters one of the pipette tips 16.

By manually rotating the handle 3 an operator can move the rack 13 laterally through the body 1, tangentially to each nozzle assembly 2 such that the rack 13 acts on each of the meshed gears 12 to rotate each sleeve 9 on the threaded part 8 of the body portion 7 of the respective nozzle assembly 2 so that the sleeves 9 move towards the respective nozzle tip 10. This compresses each O-ring seal 11 which individually increase in diameter to sealingly engage inside the respective pipette tip 16 which is thus mechanically and sealingly secured to the respective nozzle assembly 2. The apparatus can then be used to carry out a liquid handling task as required. After use, the contaminated tips 16 can be replaced in a guide plate by reversing the above pickup procedure so as to release the nozzle assemblies 2 from the tips 16. Further tips can then be attached and utilised as desired.

The illustrated apparatus is normally provided with four syringes and four nozzle assemblies 2 but the apparatus may be adapted to include various different numbers of syringes and nozzles as required.

In addition the manually operated handle 3 may be substituted by an automated arrangement, for example as described below with reference to FIGS. 5 and 6.

The resilience of the elastomeric O-ring seal 11 and its consequent effect on the location of the nozzle assemblies within the pipette tips 16 is such that manufacturing tolerances in the tips 16 do not have an adverse effect on the resultant nozzle/tip seal.

Figure 6:
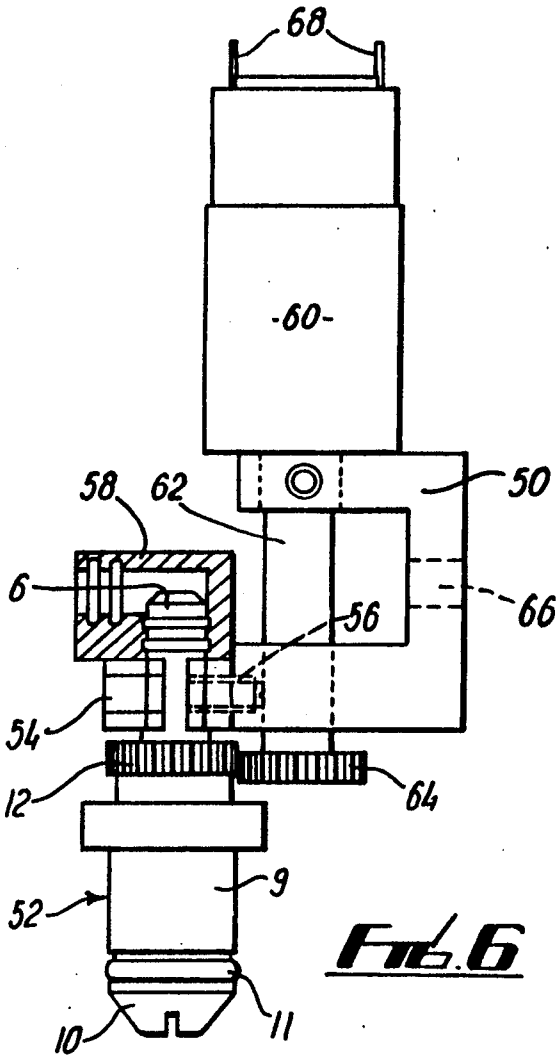
FIGS. 5 and 6 are respectively front and side elevations of a second embodiment of pipette tip apparatus in accordance with the present invention.
Figure 5:
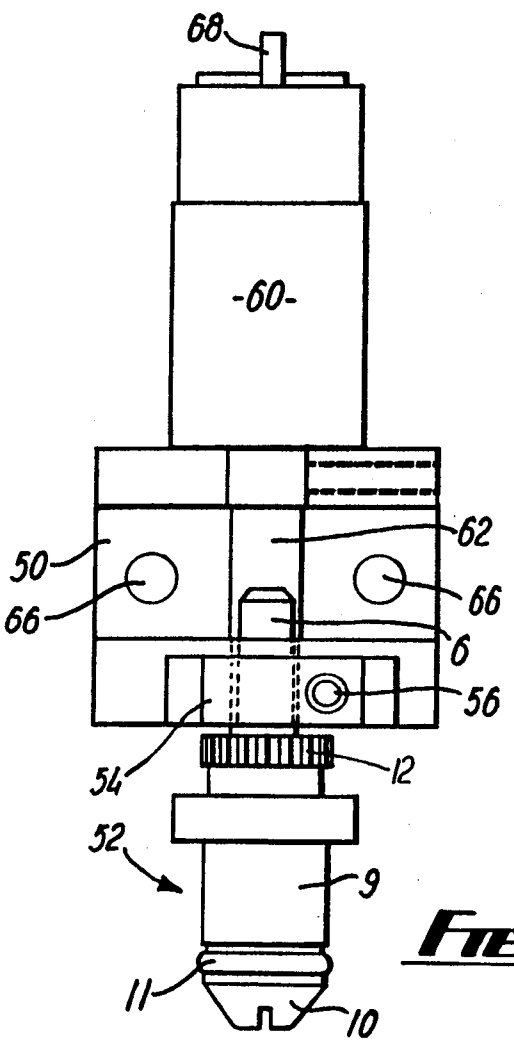

Referring now to FIGS. 5 and 6, these show respectively front and side elevations of a second embodiment of pipette tip pickup apparatus in accordance with the invention (with FIG. 6 being partly in section). The essential difference in the second embodiment compared with the first embodiment (FIGS. 1–4) is the replacement of manual operation by powered operation, specifically the replacement of the manually rotatable handle by an electric motor.

In detail the second embodiment comprises a U-shaped support bracket 50 to the lower forward edge of which a nozzle assembly 52 is secured by a clip 54 and a screw 56. The sub-components of the nozzle assembly 52 are essentially the same as for the nozzle assembly 2 of the first embodiment, save that the pneumatic/liquid connection of the upper end of the nozzle assembly 52 is by way of an elbow piece 58 (FIG. 6 only; omitted from FIG. 5). The components of the nozzle assembly 52 which match those of nozzle assembly 2 are given the same reference numerals as the latter.

The upper leg of the support bracket 50 mounts a vertical axis miniature electric motor 60 having an output shaft 62 which extends downwardly through the bracket 50 to terminate below the bracket 50 in a drive pinion 64 meshing with the sleeve pinion 12.

Figure 2:
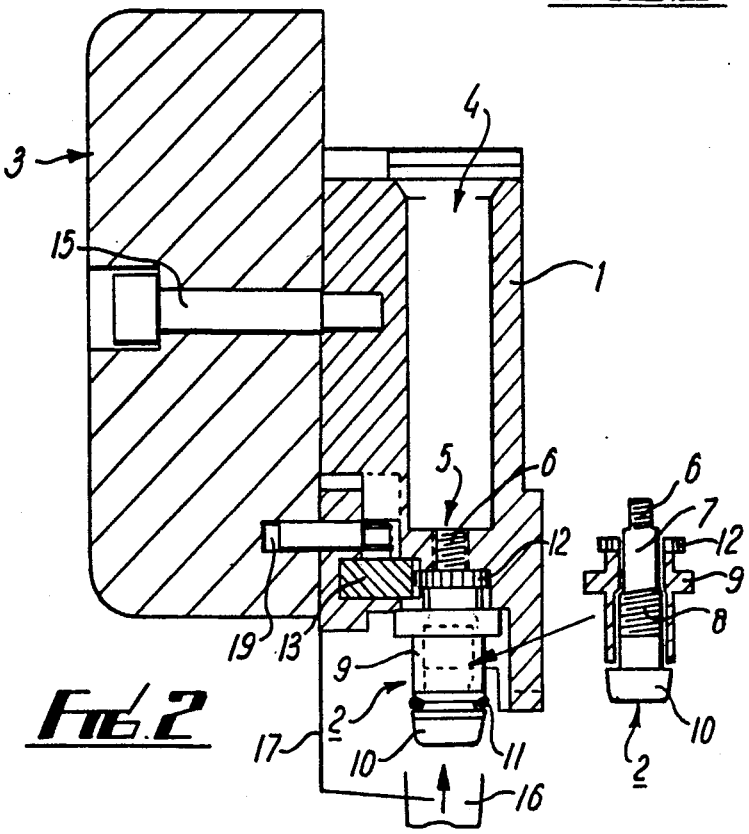
FIG. 2 is a sectional side view of the apparatus of FIG. 1.
Figure 3:
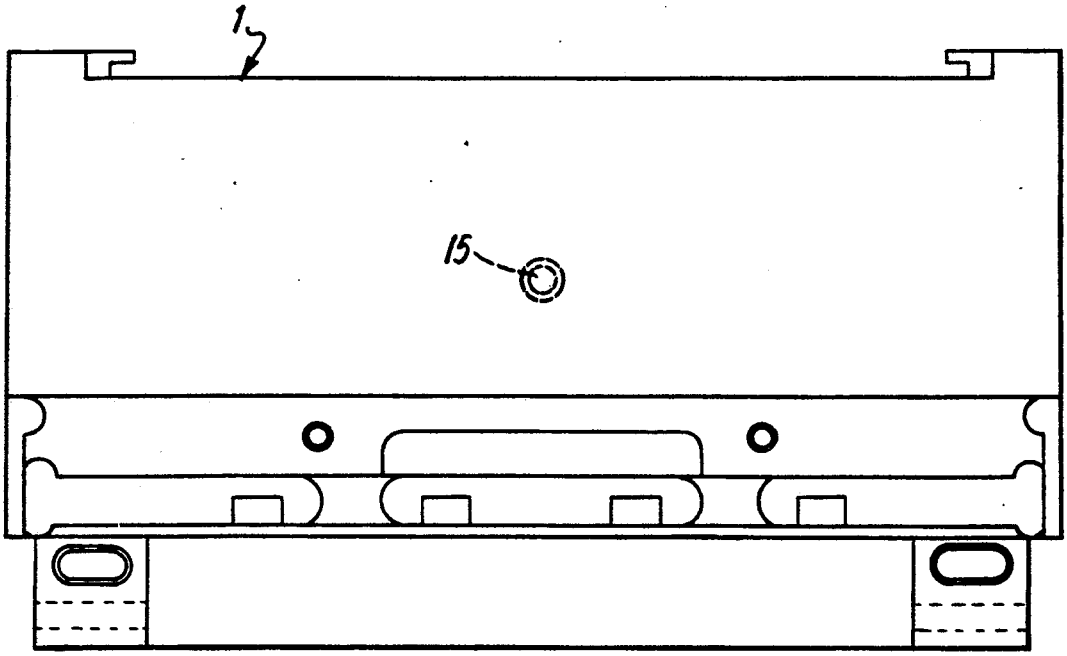
FIG. 3 is a front view of a body portion of the apparatus of FIG. 1.

In use, the second embodiment (one per syringe barrel) will be secured to a liquid dispersing station (not shown) by means of screws (not shown) passing through holes 66 in the support bracket 50 (compare FIG. 6 with FIG. 2). The elbow piece 58 is connected to the appropriate syringe barrel. A suitable controlled electric power supply (not shown) is connected to the motor terminals 68. The nozzle assembly 52 is located within a pipette tip (not shown in FIG. 5 or 6), and the motor 60 is energised by suitable control of the power supply connected to its terminals 68 to cause rotation of the nozzle assembly sleeve 9. When the O-ring seal 11 is circumferentially expanded into contact with the pipette tip, energisation of the motor 60 may be discontinued, but the motor 60 is preferably kept energised with at least a holding current such that the stall torque sustains expansion of the O-ring seal 11 to prevent inadvertent slackening of the attachment and sealing of the pipette to the nozzle assembly 52.

While a single pickup apparatus is shown in FIGS. 5 and 6 for clarity, in a multi-pipetting liquid handling station, one of the illustrated apparatus would be employed for each syringe. Each of the electric motors in the multi-pipetting arrangement is preferably supplied from a common power supply so as to ensure conjoint operation of each nozzle assembly.

The first and second embodiments of the invention, particularly in their quadruple pipetting arrangements, have a range of applications, especially in enzyme immuno-assay (EIA) tests where precisely graduated quantities of a liquid specimen are dipensed into a 96-well microtiter plate and diluted by precise amounts.

While certain modifications and variations have been described above, the invention is not restricted thereto, and other modifications and variations may be adopted without departing from the scope of the invention as defined in the appended claims.

We claim:

1. Pipette tip pickup apparatus, said apparatus comprising a syringe barrel having a nozzle to which a pipette tip may be attached or from which the pipette tip may be detached, the nozzle having an external annular groove, means to controllably vary the axial width of said annular groove, and an elastomeric O-ring seal disposed in said annular groove, the apparatus being such that upon insertion of the nozzle into a pipette tip, the axial width of the annular groove may be controllably decreased to cause a circumferential expansion of the O-ring seal whereby the nozzle becomes mechanically and sealingly attached to the pipette tip.

2. Apparatus as claimed in claim 1 wherein the annular groove is externally formed on the nozzle between a shoulder on the nozzle tip and the adjacent end of a sleeve axially moveable on the exterior of the nozzle.

3. Apparatus as claimed in claim 2 wherein the sleeve is screw-threaded on the nozzle whereby rotation of the sleeve on the nozzle causes axial displacement of the sleeve relative to the shoulder on the nozzle tip with consequent variation of the axial width of the annular groove formed therebetween.

4. Apparatus as claimed in claim 3 wherein the sleeve is rotatable on the nozzle by being gearingly coupled to a gear mechanism comprised in said means to controllably vary the axial width of the annular groove.

5. Apparatus as claimed in claim 4 wherein the gear mechanism comprises a toothed rack slideable tangentially relative to the nozzle and engaging a toothed pinion on the sleeve.

6. Apparatus as claimed in claim 5 wherein the rack is mechanically linked to a manually rotatable operating handle, rotation of the operating handle linking through the gear mechanism to rotate the sleeve and hence control variation of the axial width of the annular groove.

7. Apparatus as claimed in claim 3 wherein an electric motor is coupled to the sleeve to rotate the sleeve on the nozzle.

8. Pipette tip pickup apparatus, said apparatus comprising a plurality of syringe barrels arranged in a substantially straight row with substantially parallel axes, each syringe barrel having a respective nozzle to which a respective pipette tip may be attached or from which the pipette tips may be detached, each said nozzle having a respective external annular groove, means to controllably and conjointly vary the axial width of each said annular groove, and a respective elastomeric O-ring seal disposed in each said annular groove, the apparatus being such that upon insertion of each nozzle into a respective pipette tip, the axial width of each annular groove can be controllably and conjointly decreased to cause circumferential expansion of each O-ring seal whereby each nozzle becomes mechanically and sealingly attached to the respective pipette tip.

9. Apparatus as claimed in claim 8 wherein each said annular groove is externally formed on the respective nozzle between a shoulder on the respective nozzle tip and the adjacent end of a respective sleeve axially movable on the exterior of each nozzle.

10. Apparatus as claimed in claim 9 wherein each said sleeve is screw-threaded on the respective nozzle whereby rotation of the sleeve on the respective nozzle causes axial displacement of the sleeve relative to the shoulder on the respective nozzle tip with consequent variation of the axial width of the respective annular groove formed therebetween.

11. Apparatus as claimed in claim 10 wherein each said sleeve is rotatable on the respective nozzle by being gearingly coupled to a gear mechanism comprised in said means to controllably vary the axial width of each annular groove.

12. Apparatus as claimed in claim 11 wherein there is a toothed pinion on each sleeve and a toothed rack meshed with each said pinion, the rack being slidable tangentially relative to each nozzle.

13. Apparatus as claimed in claim 12 wherein the rack is mechanically linked to a manually rotatable operating handle, rotation of the operating handle linking through the gear mechanism to rotate each sleeve and hence control variation of the axial width of each said annular groove.

14. Apparatus as claimed in claim 10 wherein a respective electric motor is coupled to each said sleeve to rotate the sleeves on the respective nozzles.

* * * * *